US006779908B1

(12) United States Patent
Ng

(10) Patent No.: US 6,779,908 B1
(45) Date of Patent: Aug. 24, 2004

(54) ADJUSTABLE DOWNLIGHT LIGHTING FIXTURE

(75) Inventor: Sherman Ng, South Darthmouth, MA (US)

(73) Assignee: Genlyte Thomas Group LLC, Louisville, KY (US)

( * ) Notice: Subject to any disclaimer, the term of this patent is extended or adjusted under 35 U.S.C. 154(b) by 0 days.

(21) Appl. No.: 10/040,792

(22) Filed: Jan. 7, 2002

(51) Int. Cl.[7] ..... F21V 21/30

(52) U.S. Cl. ..... 362/147; 362/269; 362/365; 362/421

(58) Field of Search ..... 362/147, 148, 362/150, 269, 287, 364, 365, 366, 372, 421

(56) References Cited

U.S. PATENT DOCUMENTS 2,554,258 A * 5/1951 Llundquist ..... 362/364
RE24,258 E * 12/1956 Burliuk ..... 363/269
5,377,087 A * 12/1994 Yoon ..... 362/148
5,452,193 A * 9/1995 Hinnefeld et al. ..... 362/366
5,457,617 A * 10/1995 Chan et al. ..... 362/366
5,562,343 A * 10/1996 Chan et al. ..... 362/365
5,672,004 A * 9/1997 Schmidt, Jr. ..... 362/421
5,823,664 A * 10/1998 Demshki, Jr. et al. ..... 362/366
5,857,766 A * 1/1999 Sieczkowski ..... 362/365

* cited by examiner

*Primary Examiner*—Alan Cariaso
(74) *Attorney, Agent, or Firm*—Charles G. Lamb; Middleton Reutlinger

(57) ABSTRACT

An adjustable downlight lighting fixture includes a rotatable housing of hemispherical configuration rotatably mounted within a stationary lower outer housing which is also of hemispherical shape with a top opening cut at a preselected angle to horizontal so that a lamp disposed within the rotatable housing may be positional at preselected angles to vertical for downlighting through a ceiling opening. The lower outer housing is integral with a base or mounting frame for attachment to an opening in a ceiling through which light from the lamp in the rotatable housing passes.

5 Claims, 3 Drawing Sheets

ADJUSTABLE DOWNLIGHT LIGHTING FIXTURE

BACKGROUND OF THE INVENTION

The present invention relates to an adjustable downlight lighting fixture and more particularly the present invention relates to an adjustable downlight lighting fixture, which can be recessed above a ceiling and installed through an opening from below the ceiling.

Typical ceiling mounted recessed lighting fixtures generally include a frame with means for securing the frame to structural supports for a ceiling. The frame of the lighting fixture generally includes holes or brackets through which fasteners are used to position and attach the fixture to the supports. These supports generally include a metal grid work spaced a fixed distance apart and spaced from an overhead structure. In attaching the lighting fixture to the grid work, the frame of the lighting fixture is usually provided with guide ways for connecting with the grid at a desired position. And, the lighting fixtures are usually installed prior to the completion of the ceiling, as the housing for the fixtures are generally larger than the openings in the ceilings and therefore cannot be installed once the ceiling is in place.

Ceiling mounted recessed fixture are widely used for both residential and commercial use. And, lighting fixtures, which are vertically adjustable and can be installed from below the ceiling after the ceiling has been in place is a need that exists in the lighting industry.

SUMMARY OF THE INVENTION

It is an object of the present invention to provide a recessed lighting fixture that can be installed from below the ceiling when the ceiling is in place.

It is another object of the present invention to provide a downlight lighting fixture which provides a vertical adjustment of greater than 35°.

It is another object of the present invention to provide an adjustable downlight lighting fixture for a recessed ceiling which is easy to install and economical in cost.

More particularly, the present invention provides an adjustable downlight lighting fixture which includes a base or frame having a bottom opening therein which is integral with an outer housing having a top opening. A reflector trim is disposed within and spaced from the outer housing wherein the reflector trim is also provided with a bottom opening and a top opening wherein the bottom opening is in the same horizontal plane as the base or frame bottom opening. A rotatable housing having a lower section is rotatably received within the outer housing top opening. A lamp socket assembly is disposed within the rotatable housing and is rotatable with the rotatable housing.

Further objects and advantages of the present invention will become apparent to those skilled in the art from the following detailed description, which, in conjunction with the accompanying drawings, discloses the preferred embodiment of the present invention.

BRIEF DESCRIPTION OF THE DRAWINGS

A better understanding of the invention will be had upon reference to the following description in conjunction with the accompanying drawings in which like numerals refer to like parts throughout the several views and wherein.

DETAILED DESCRIPTION OF THE PREFERRED EMBODIMENT

Figure 1:
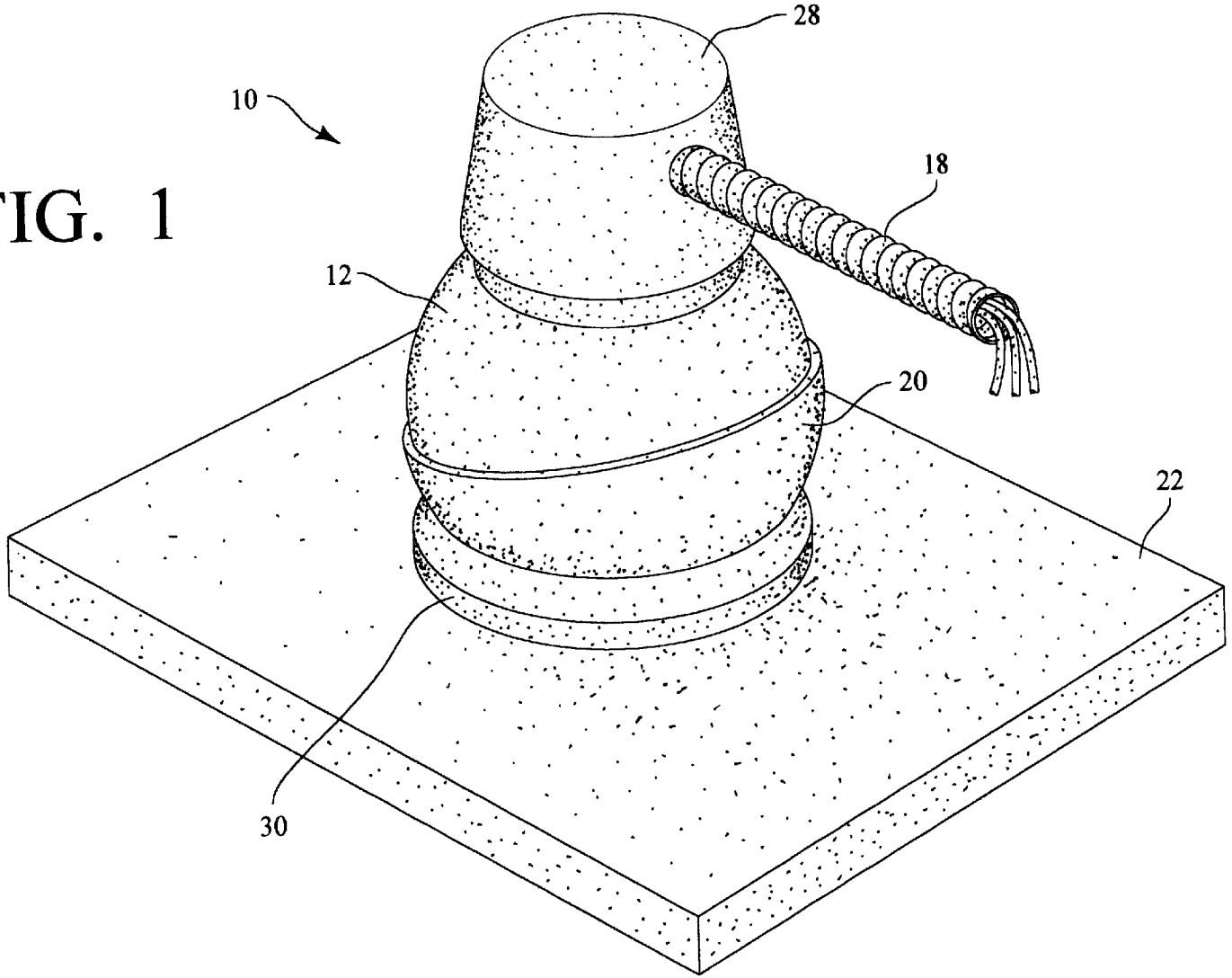
FIG. 1 is a perspective view of an adjustable downlight lighting fixture of the present invention.
Figure 2:
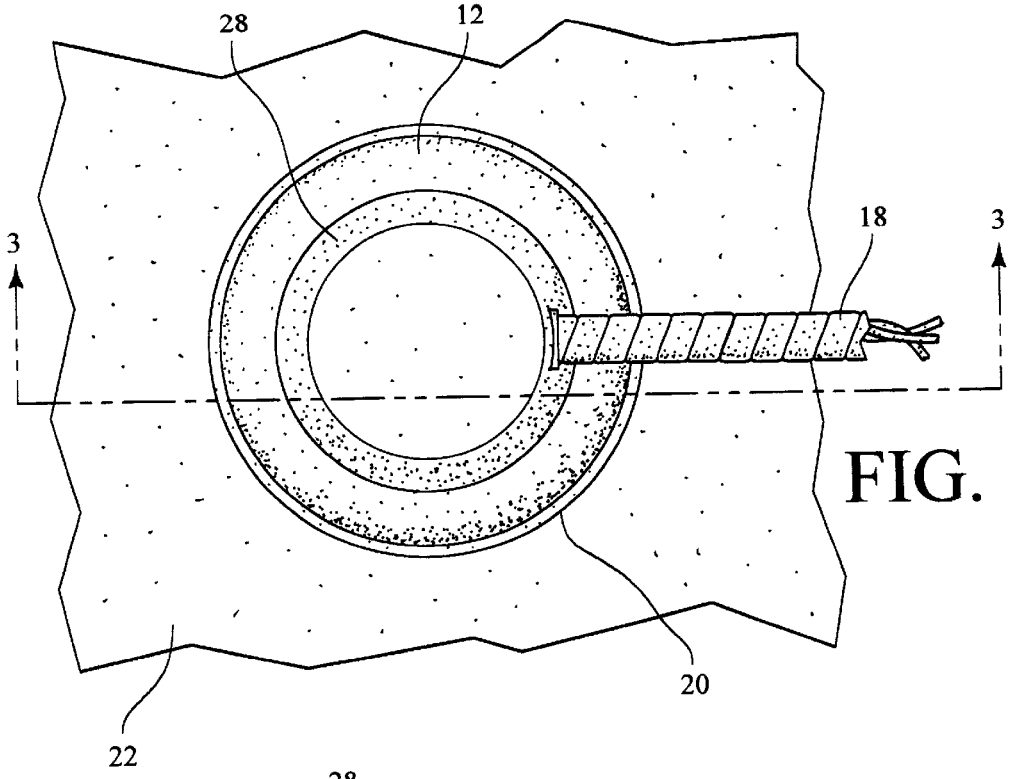
FIG. 2 is a top view of the adjustable downlight lighting fixture of FIG. 1.
Figure 3:
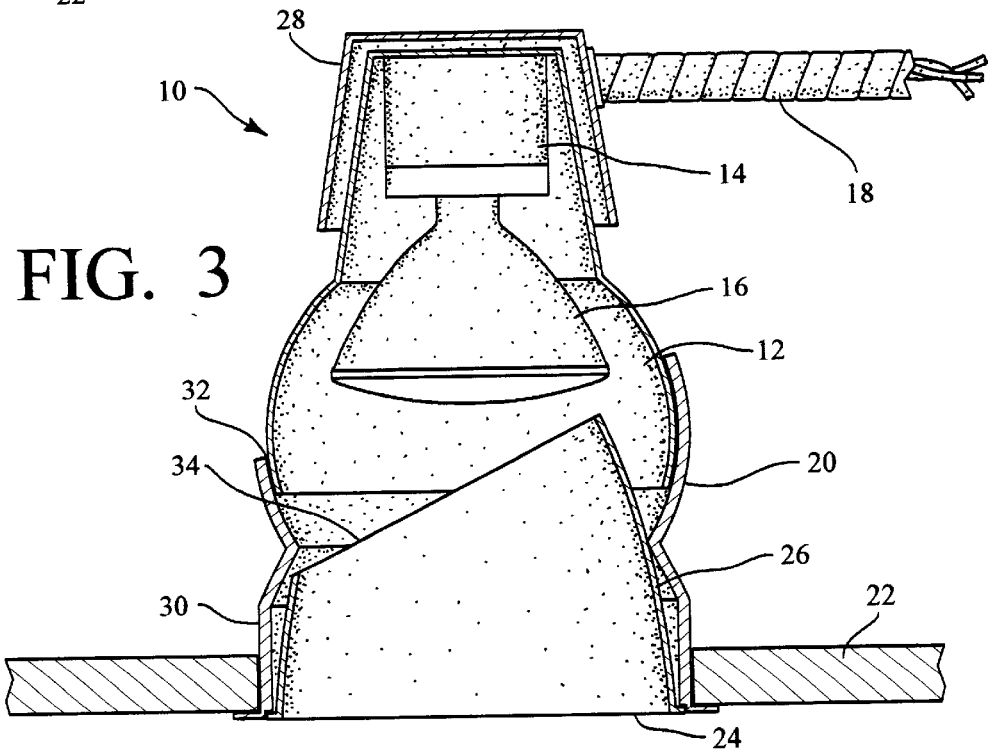
FIG. 3 is a sectional view taken along line 3—3 of FIG. 2 showing the adjustable lighting fixture with a lamp therein in a vertical orientation; and, FIG. 4 is a sectional view similar to FIG. 3 with the adjustable lighting fixture rotated from the vertical axis at a preselected angle.

In FIGS. 1 and 2 is shown an adjustable downlight lighting fixture 10. As shown in FIGS. 1 and 2, the downlight lighting fixture includes a rotatable housing 12, which is received within a stationary outer housing 20. Rotatable housing 12 is generally hemispherical shaped from rolled and die-formed steel. The outer housing 20, which is integral with the frame or base 30 is generally constructed from a rust-cast aluminum suitable for attaching to dry or poster ceilings. Rotatable housing 12 is designed to snugly fit within the hemispherical shaped outer housing 20, housing 20 having a truncated top opening at a preselected angle to horizontal, the truncated opening being identified by the numeral 32 (FIG. 3). The outer housing 20 is integral with the base or frame portion 30, which is suitable for attachment to the dry, or poster ceilings.

Figure 4:
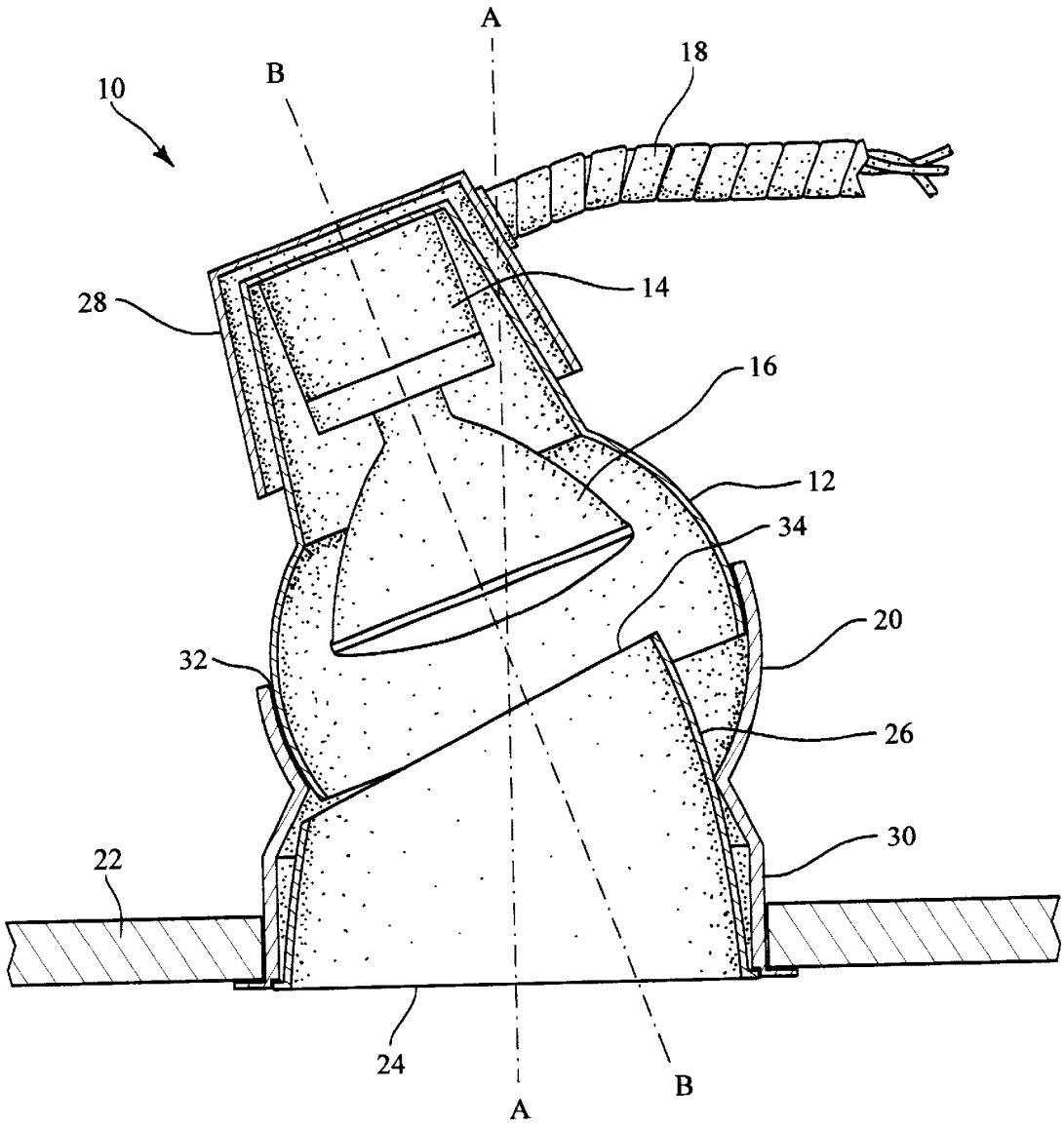

As shown in FIGS. 3 and 4, base 30 circumscribes a reflector trim 26 which is a truncated reflector cone having a top opening, identified by the numeral 34, and a bottom opening, identified by the numeral 24, which is in the same plane as a bottom opening into the mounting frame 30. The reflector trim 26 may be detachably attached at its foremost edges to the inner edge of the mounting frame 30 by any well-known means. Moreover, the mounting frame 30 may be attached by any well-known means to the ceiling 22.

With continued reference to FIGS. 3 and 4, a socket assembly 14 is attached to the uppermost portion of the rotatable housing 12 and is movable, as shown in FIG. 4, with the rotatable housing 12. The socket assembly 14 receives a lamp 16 therein, the lamp 16 generally being incandescent, and the socket assembly 14 in turn is in electrical communication with an electrical cable 18. A heat dissipating aluminum cover 28 is provided to cover the socket assembly 14 and close the uppermost end of the rotatable housing 12. It is realized that the lamp identified by the numeral 16 can be an incandescent source, flourescent, or HID. The outer housing 20 of integral mounting frame 30 is generally of a resilient aluminum which, upon installation, slides easily within the opening 24 of the ceiling 22. Also, the rotatable housing 12 is generally also resilient so that it also will slip easily through the opening 24 so that the installation of the adjustable lighting fixture can be accomplished from below the ceiling.

As shown in FIG. 4, rotatable housing 12 is rotatable in the outer housing 20 with a vertical adjustment greater than 350. As shown in FIG. 4, the center of the beam of light, identified by the line B—B, is provided by tilting lamp 16 at a preselected pivot angle to the vertical line A—A. The truncated opening 32 is generally cut so that the lamp 16 can be tilted to and greater than 35° to the vertical line A—A.

The foregoing detailed description is given primarily for clearness of understanding and no unnecessary limitations are to be understood therefrom for modifications will become obvious to those skilled in the art upon reading this disclosure and may be made without departing from the spirit of the invention and scope of the appended claims.

What is claimed is:

1. An adjustable downlight lighting fixture comprising:

a base having a bottom opening integral with an outer housing of hemispherical shape having a truncated top opening at a preselected angle to horizontal;

a reflector trim disposed within said base and spaced inwardly from said outer housing, said reflector trim having a bottom opening and a truncated top opening at a preselected angle to horizontal, said reflector trim bottom opening being in the same horizontal plane as said base bottom opening;

a rotatable housing having a lower section rotatably received within said outer housing; and, a lamp socket assembly disposed within said rotatable housing and movable with said rotatable housing.

2. The fixture of claim 1, said rotatable housing being of generally hemispherical shape.

3. The fixture of claim 1 including an incandescent lamp.

4. The fixture of claim 1 including a cover for said lamp socket assembly, said cover being of a heat dissipating material.

5. The fixture of claim 1, said reflector trim being a truncated cone.

* * * * *